US008109404B2

(12) United States Patent
Chmela

(10) Patent No.: US 8,109,404 B2
(45) **Date of Patent: *Feb. 7, 2012**

(54) CAP FOR SHIPPING AND STORAGE CONTAINERS INCLUDING TWO TYPES OF TAMPER EVIDENCE

(75) Inventor: James F. Chmela, Algonquin, IL (US)

(73) Assignee: Snap Seals, Inc., Thousand Oaks, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/052,886

(22) Filed: Mar. 21, 2011

(65) Prior Publication Data

US 2011/0168660 A1 Jul. 14, 2011

Related U.S. Application Data

(63) Continuation of application No. 10/440,582, filed on May 19, 2003, now Pat. No. 7,931,167.

(51) Int. Cl.

| | |
|---|---|
| ***B65D 17/34*** | (2006.01) |
| ***B65D 41/32*** | (2006.01) |
| ***B67B 1/00*** | (2006.01) |
| *B65D 51/18* | (2006.01) |

(52) U.S. Cl. ..... 220/270; 220/268; 220/266; 220/257.2; 215/254; 215/253; 222/153.07; 222/153.1

(58) Field of Classification Search ..... 220/270, 220/268, 266, 265, 257.2, 257.1, 601, 724; 215/254, 253, 251; 222/153.04, 153.14, 222/153.1

See application file for complete search history.

(56) References Cited

U.S. PATENT DOCUMENTS

| | | | |
|---|---|---|---|
| 1,549,080 | A | 8/1925 | Henson |
| 2,156,540 | A | 5/1939 | Melrath |
| 2,643,015 | A | 6/1953 | Soffer |
| 3,380,609 | A | 4/1968 | Potts |
| 3,465,906 | A | 9/1969 | Wagner et al. |
| 3,701,454 | A | 10/1972 | Thorp |
| 4,003,488 | A | 1/1977 | Moller |
| 4,098,420 | A | 7/1978 | Torii |
| 4,384,654 | A | 5/1983 | Hospes |
| 4,453,644 | A | 6/1984 | Berglund |
| D281,584 | S | 12/1985 | Berglund |
| 4,573,605 | A | 3/1986 | Udell |
| 4,593,830 | A | 6/1986 | Bullock |

(Continued)

FOREIGN PATENT DOCUMENTS

| | | | |
|---|---|---|---|
| EP | 0652162 | A2 | 5/1995 |

(Continued)

*Primary Examiner* — Robin Hylton
(74) *Attorney, Agent, or Firm* — SoCal IP Law Group LLP; Jonathan Pearce; Steven C. Sereboff

(57) ABSTRACT

A tamper evident cap adapted to close an opening on a vessel includes a main body having an outer circumference, a pull tab extending from the main body, and a flange, forms an annulus around the main body and connected to the main body. The flange includes an outer circumference that is larger than the outer circumference of the main body. It is essential to the present invention that the flange is made of a very thin layer of material. In addition, the flange includes at least a pair of perforation lines. Further, the present invention includes a bump in the pull-tab for enabling a person grasping the pull-tab, to obtain a firmer hold thereon.

18 Claims, 2 Drawing Sheets

U.S. PATENT DOCUMENTS

| | | | | |
|---|---|---|---|---|
| 4,676,389 | A | 6/1987 | Bullock | |
| 4,678,094 | A | 7/1987 | Bullock | |
| 4,712,705 | A | 12/1987 | Fuehrer | |
| 4,721,210 | A | 1/1988 | Lawrence et al. | |
| 4,738,375 | A | 4/1988 | Rosen et al. | |
| 4,834,252 | A | 5/1989 | Crisci | |
| 4,934,546 | A | 6/1990 | Merkley | |
| 5,036,991 | A | 8/1991 | Wallman | |
| 5,085,333 | A | 2/1992 | Dutt et al. | |
| 5,145,084 | A | 9/1992 | Murayama et al. | |
| D363,429 | S | 10/1995 | Lee | |
| 5,687,865 | A | 11/1997 | Adams et al. | |
| 5,810,190 | A | 9/1998 | Welch | |
| D436,862 | S | 1/2001 | Witt et al. | |
| D469,353 | S | 1/2003 | Sturk | |
| D475,925 | S | 6/2003 | Sturk | |
| 6,681,947 | B2 | 1/2004 | Kim et al. | |
| D608,204 | S | 1/2010 | Caroen et al. | |
| D612,236 | S | 3/2010 | Sturk | |
| 7,931,167 | B2 * | 4/2011 | Chmela | 220/270 |
| 2004/0144786 | A1 | 7/2004 | Chmela et al. | |

FOREIGN PATENT DOCUMENTS

| | | |
|---|---|---|
| GB | 2121773 | 1/1984 |

* cited by examiner

CAP FOR SHIPPING AND STORAGE CONTAINERS INCLUDING TWO TYPES OF TAMPER EVIDENCE

RELATED APPLICATION INFORMATION

This patent is a continuation of and claims priority to U.S. patent application Ser. No. 10/440,582, now U.S. Pat. No. 7,931,167 entitled "Tamper Evident Cap for Shipping and Storage Containers" filed on May 19, 2003 and issued on Apr. 26, 2011.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

The present invention relates to a tamper evident cap for shipping and storage containers. More specifically, the invention concerns a tamper evident cap constructed and arranged to snap fit onto the opening of a steel drum.

2. Description of the Related Art

Vessels or drums of various sizes and shapes are used commercially to store, ship and dispense various substances. Metals drums, which are typically standardized to capacities of, for example, 15-gallon, 30-gallon and 55-gallon, are commonly used to carry an abundance of liquid products, including oil, petrochemicals, chemicals, solvents, water, and the like.

Drums vessels are constructed of a usually cylindrical sidewall and a flat circular lid and a flat circular bottom. An opening is provided in the vessel or its lid to allow the vessel to be filled and to allow the contents of the vessel to be dispensed. The vessel opening is typically sealed with a removable closure or cap. The cap is typically threaded into the opening and forms a seal to prevent the contents from escaping from the vessel.

Without some type of tamper-evident feature, the closure could be removed at virtually any time, such as during shipping or storage, without being noticed. This would mean that someone could tamper with the drum contents without being discovered. This tampering could include partial removal of the drum contents and/or contamination of the drum contents by a foreign substance. Having a tamper-evident feature provides a desirable enhancement to the plug-flange fitting combination.

There is a growing demand today for vessel closure, which provide a visual indication if the vessel has been opened or tampered with in any way.

In general, the prior art uses a closure plug or cap and a covering device (over cap) having a breakable seal, which must be broken to gain access to the closure plug or cap. Some of these tamper evident closures include a tear band, which prevents removal of the closure until the tear band has been irreversibly severed from the closure cap.

In order to provide an indication of prior access to the contents of the vessel, the prior art also teaches a tamper evident cover may be placed over the cap. Certain existing covers or other closures for this purpose use a tear strip along the skirt of the cover that must be removed to remove the cover. A pull-tab or ring is attached to the tear strip, and when the tab or ring is pulled, the tear strip is torn, and the cover may be removed from the vessel. A torn or missing tear strip evidences prior removal of the cover and possible tampering with the contents of the vessel.

Before the cap can be removed from the opening of the vessel that is sealed by the cap, it is necessary to first separate the skirt from the cap before proceeding with the removal of the cap. Typically, these skirts extend downwardly away from the lower edge of the cap. Inspection of the integrity of the skirt will readily indicate whether unauthorized removal of the cap may have occurred. Such unauthorized removal may be attempted by inserting a fingernail or other suitable implement such as the edge of a screwdriver under the edge of the cap. If such prying is attempted, the skirt usually will break away from the edge of the cap and thus serve as an indication of the tampering.

U.S. Pat. No. 5,875,908, entitled "Bottle Cap" to Witt, et al. discloses a reusable bottle cap with a removable tamper evident tear strip or ring. In the Witt device, a plurality of teeth on the tear strip snap under a shoulder on the neck of a milk bottle so that the cap cannot be removed without first removing the tear strip. The tear strip is separable from the cap by a series of frangible tabs, and the tear strip includes a pull ring. When the pull ring is pulled to remove the tear strip, the tabs are broken in series, and the tear strip is separated from the cap. The tear strip is an open annulus so when it is separated from the cap, it can be removed from the bottleneck.

While this may have represented an improvement over former milk bottle closures such as friction fitted cardboard disks, crimped on aluminum foil caps, or crimped on paper caps, it does not provide a sufficient level of tamper evident security to meet current demands. Although the plurality of teeth of Witt will retain the cap and tear strip to the bottle, it is still possible to bend the individual teeth of the Witt device one at a time and effect removal of the cap without destroying the cap, thereby permitting removal and replacement of the cap without detection.

U.S. Pat. No. 5,944,229, entitled "Drum Valve System with Tamper Evident Cap" to Rokkjaer discloses a tamper evident cap for a drum in which the cap has a ledge that snaps under a capturing surface on the drum. When a frangible strip is pulled, the cap is partially torn, and evidence of removal or possible tampering is provided. However, when the strip is removed, it is still necessary to compress the two severed halves of the cap together to effect release of the ledge from the capturing surface on the drum. With this arrangement, while a secure tamper evident cap is provided, the cap is difficult to install, and even more difficult to remove, requiring specific training of personnel at both the filling and dispensing ends of the shipping or storage cycle of the drum.

Another tamper evident cap for use with a drum is shown in U.S. Pat. No. 5,996,833, entitled "Tamper Evident Dust Cover for a Drum Bung" to Lencioni, et al, and discloses a locking annular ring snaps under a lip formed on a neck of the drum, but must be forced onto the neck with great effort with only two major and two minor slots to allow deformation of the ring to pass over the lip and into locked position.

Finally, U.S. Pat. No. 6,193,921, entitled "Method of Making Container Lid with Tamper Evident Slip Band" to Nelson, discloses a container lid having an integrally formed tamper evident flange. The flange is made of a thin web and includes several rupture sections to evidence tampering.

Notwithstanding the improvements offered by the closure caps disclosed in the above-noted patents, certain of these closure caps suffer from certain disadvantage in that it is possible to pry off the cap and frangible skirt together in one motion without causing any damage or separation of the skirt from the major portion of the cap itself. Additionally, the structure of these caps is such that inadvertent prying off of the cap or separation of the skirt from the remaining portion of the cap may occur when any protruding portion of the skirt is caught by nearby objects.

Another disadvantage presented by the tamper proof covering of the prior art is that the filling house which fills containers with consumable product must perform separate operations, to successively install the closure plug or cap, and then to install the over cap. These separate operations, and the separate handling of these separate parts, necessarily mean substantial expense as compared to merely making the closure alone.

It then becomes important to configure a tamper-evident feature that is reliable, easy to install or assemble, and relatively inexpensive.

It is also important to provide a tamper evident closure with provides a clear, reliable indication of previous removal or tampering yet can be produced in a straight draw mold without cams or slides.

It is also important to provide a tamper evident closure, which does not require the use for extra separate parts (over cap), and at the same time, provides the same protection of a tamper evident over cap.

There is a further need for such a tamper evident closure that is so distorted in removal that it cannot be replaced without providing an easily recognized indication that it has been removed.

SUMMARY OF THE INVENTION

It is therefore an object of the present invention to provide a novel tamper evident closure for a vessel that overcomes the problems experienced with prior devices.

It is yet another object of the present invention to provide a tamper-evident closure construction of the type set forth, which is of a simple and economical construction.

It is yet another object of the present invention to provide a tamper evident closure for that and relatively inexpensive to manufacture.

It is yet another object of the present invention to provide a tamper evident closure that is easy to install and remove without requiring special training of operating personnel.

These and other objects of the invention are achieved by providing a tamper evident closure for engaging a vessel mouth that can be easily lined in a single step and without special equipment, therefore providing a superior product at a reduced cost.

The present invention is an improvement to the above patents and to the prior art, providing a simple yet effective tamper evident closure that eliminates the need for extra separate parts (over cap) that can be easily loosened or dislodged.

The unitary, molded plastic design of the present invention satisfies the "inexpensive" criteria. The snap-on or snap-fit design of the present invention satisfies the "easy to install" criteria and cooperates in satisfying the "reliable" criteria. The use of a removable (i.e., frangible) skirt as disclosed by the present invention satisfies the "reliable" criteria and does so in a novel and unobvious manner.

The present invention concerns a tamper evident cap adapted to close an opening on a vessel, the tamper evident cap comprising:

a main body having an outer circumference;

a pull tab extending from the main body; and a flange forming an annulus around the main body and connected to the main body, the flange having an outer circumference that is larger than the outer circumference of the main body;

wherein the flange is made of a very thin layer of material; and wherein the flange includes at least a pair of perforation lines.

Further, the present invention includes a bump in the pull-tab for enabling a person grasping the pull-tab to obtain a firmer hold thereon.

The tamper evident cap of the present invention is formed of a single piece of molded plastic.

The main body comprises a cup shape having a top, a sidewall descending downwardly from the top, and a frangible strip extending across a portion of said side wall and across at least a portion of said top, wherein the side wall includes an inner side and an outer side.

The present invention further comprises a continuous annular lip in the inner side of the sidewall and a frangible strip provided across a portion of the wall and across the upper surface of the main body.

The foregoing has outlined rather broadly the more pertinent and important features of the present invention in order that the detailed description of the invention that follows may be better understood, and the present contribution to the art can be more fully appreciated. Additional features of the invention will be described hereinafter, which form the subject of the claims of the invention. It should be appreciated by those skilled in the art that the conception and the specific embodiments disclosed may be readily utilized as a basis for modifying other security systems for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

Further advantageous embodiments, as well as advantages achieved by means of the invention, will be explained below in greater detail with reference to the drawing, which shows a structure by way of example, and in which.

DETAILED DESCRIPTION OF THE INVENTION

The present invention is concerned with a snap-on cap, which together with a vessel having a suitably configured opening, provides an improved sealing of the vessel opening in combination with the inner sealing characteristics of the snap-on tamper proof cap.

In addition, the tamper evident cap according to the present invention assures relatively more positive identification of intentional or inadvertent prying of the cap off the container.

Also, the tamper proof cap of the present invention discourages such intentional prying and furthermore safeguards against inadvertent prying.

Figure 1:
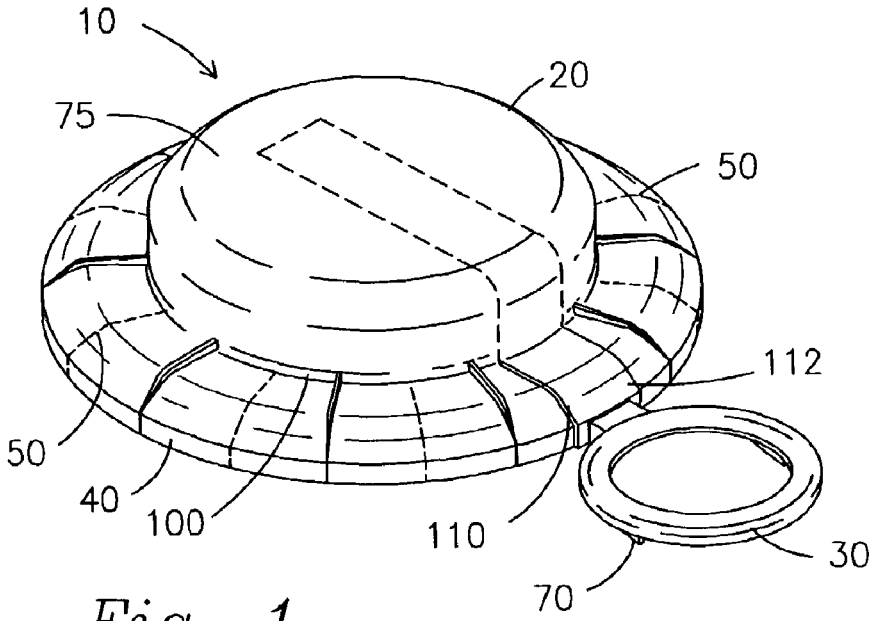
FIG. 1 is a perspective view of the tamper evident cap of the present invention shown in its manufactured, uninstalled position.
Figure 2:
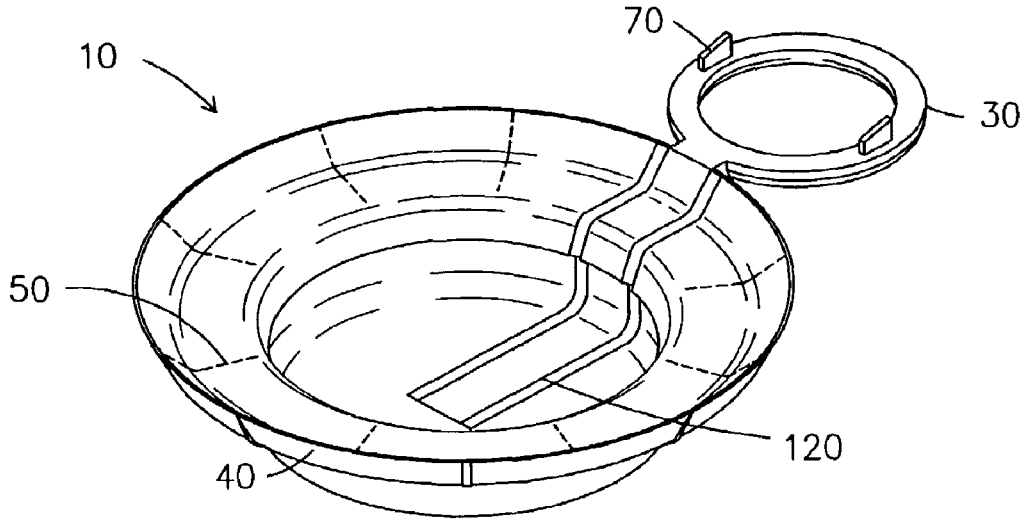
FIG. 2 is a perspective top view of the tamper evident cap of FIG. 1.
Figure 3:
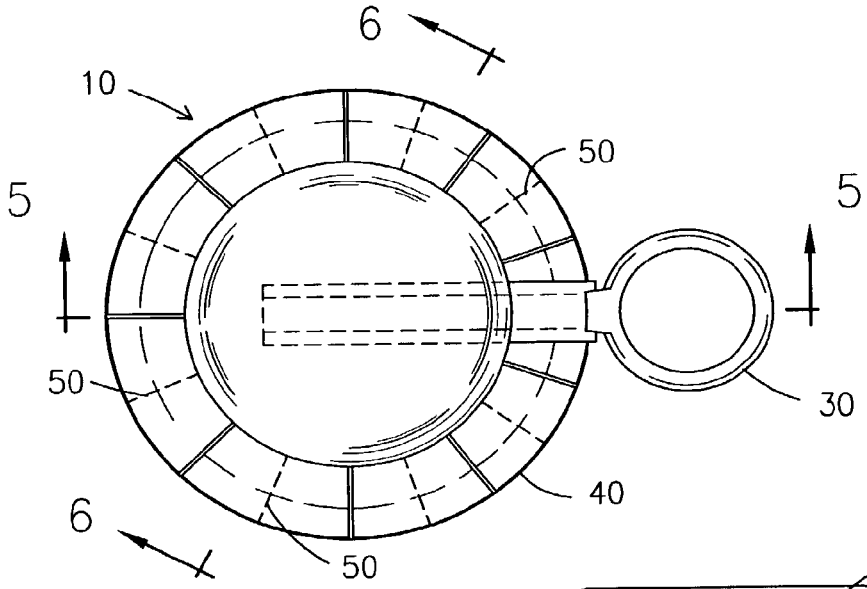
FIG. 3 is a planar top view of the tamper evident cap of FIG. 1.
Figure 4:
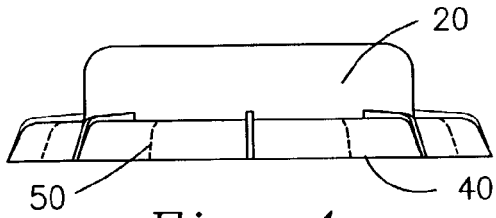
FIG. 4 is a side view of the tamper evident cap of FIG. 3.

FIG. 1 shows the one piece tamper evident cap 10 adapted to close an opening on a vessel (not shown), the tamper evident cap comprising:

a main body 20 having an outer circumference;

a pull tab 30 extending from the main body 20; and a flange 40 forming an annulus around the main body 20 and connected to the main body 20, the flange 40 having an outer circumference that is larger than the outer circumference of the main body 20;

wherein the flange includes at least a pair of perforation lines 50.

Figure 5:
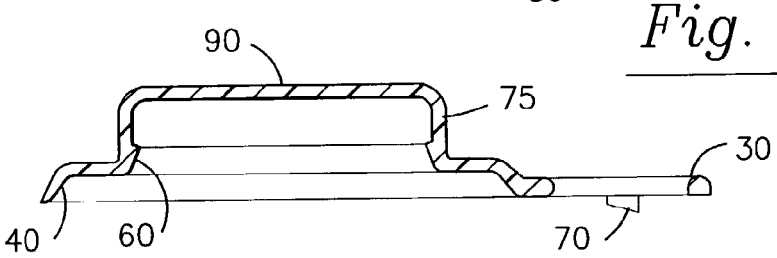
FIG. 5 is a sectional cross view of the cap of FIG. 3, taken along line 5-5 of FIG. 3.
Figure 6:
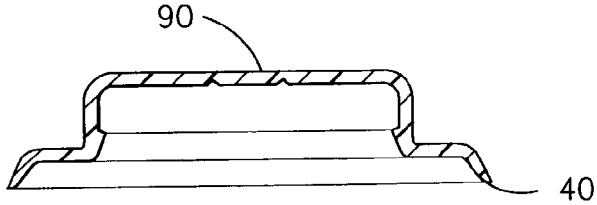
FIG. 6 is a sectional cross view of the cap of FIG. 3, taken along line 6-6' of FIG. 3.

In addition, the present invention comprises at least one bump 70 in the bottom side of the pull tab 30 for enabling a person grasping the pull tab 30 to obtain a firmer hold thereon due to its unique configuration. (FIGS. 1 and 5)

Those skilled in the art will observe that the cap 10 for vessels disclosed herein is adapted to be snap-fit on the opening of a vessel by a downward vertical movement imparted to the cap 10 and that in order that the cap can be removed, the pull tab 30 must be grasped and the flange removed to free the annular groove comprising a fastening configuration from the opening of the vessel on which the cap has been positioned. The removal of the flange from the opening is greatly facilitated by the provision of the pull-tab 30 and its integral formation with the flange. The construction and detailing of the cap insures easy and rapid removal of the flange.

One of the main points to the success of the present invention is the placement of the lower edge of the very thin layer of the flange against the surface of the vessel opening or at least in extremely close proximity to the surface of the vessel opening. By not leaving any noticeable clearance space or at most a space with only a few thousandths of an inch gap, there is effectively no room for a blade or edge of any type of utensil, implement, or hand tool to slide beneath the flange in hopes of removing the cap without this attempt being revealed by the fracture of one or more of the connecting frangible elements. As will be clearly explained, any such inserting and prying attempt causes the fracture of at least one of the perforation lines, and this is sufficient to reveal (visually) that a tampering attempt has been tried.

In the basic preferred embodiment of the invention, the cap is formed of a single piece of molded plastic.

The main body 20 is generally cup-shaped, having a top portion 90 with an annular sidewall 75 descending downwardly from the top.

The cap is preferably made from a plastic material, such as high density polyethylene (HDPE), polypropylene (PP), low density polyethylene (LDPE), polybutylene (PB), a blend of ethylene vinyl acetate (EVA) with PB, COPP, ultra low density ethylene copolymers, polyolefin plastomers, and/or polyethylene.

The top portion and wall 75 are joined (unitary construction) at a circumferential edge. The lower end of the sidewall 75 includes an continuous annular lip 60 in the inner side of the sidewall 75 which constitutes a hook for the snap-fit of the cap 10 onto the opening of the vessel (FIG. 5).

As a significant advantage, this construction permits the cover to be molded easily, straight up and down, thereby providing a tamper evident cover that provides superior performance and can be manufactured very efficiently and inexpensively.

To permit removal of the cap after it has been installed on a vessel opening, a frangible strip 120 is provided across a portion of the sidewall 75 and across the upper surface 90 of the main body 20. To form the frangible strip 120, pair of frangible lines is molded into the main body of the cap, and to facilitate separation of the strip 120 from the upper surface 90, a pull-tab 30 is attached to the frangible strip 120.

The only way to open the cap is by pulling the pull-tab, which will partially split the cap in two and will release the opening of the vessel from the continuous annular lip 60 of the cap 10.

To prevent tearing along the line 100 completely around the circumference of the main body 20, there is thickening lines 110 and 112 on the pull-tab 30, which stops tearing. Continuous annular lip 60 is interrupted in the region between lines 110.

It is critical for the present invention that the flange 40 is made of a very thin layer of material.

The flange thickness is between 0.005 to 0.040 of an inch, preferably between 0.010 to 0.020 of an inch.

The flange 40 is preferably formed depending from the main body 20 and fitting inside the opening of the vessel in a manner well understood in this art.

In use, cap 10 is installed on the opening of the vessel by pushing downward until the flange reaches the base of the opening and the outward rib engages of the top of the opening. Access to the opening main body of the cap in order to pry the cap free from the opening of the vessel is not possible until the pull-tab is removed from the cap, a step that requires the severing of the continuous annular lip 60 of the cap 10.

In the preferred embodiment, the main body of the cap has a diameter between 1.0-2.5 inches and a height between 0.25-1.0 inch.

If even one perforation line is broken, this would indicate that some type of tampering effort may have been attempted. The design of the cap of the present invention makes it virtually impossible to insert any type of tool, implement, or utensil into the slight clearance space and then lift up on the flange in order to try and reach the outward rib 60 of the cap without at least one of the perforation lines 50 breaking. Consequently, the cap 10 provides a unique and very effective tamper-evident structure for use with opening of vessels There is always some risk that through careless handling or other inadvertent activities, one or more of the lines perforations will be broken, and thereby send a false signal of a tampering attempt. However, the minimal distance of separation between the cap and the skirt, and the limited clearance space of the lower edge of the flange against the upper surface of the vessel opening strongly suggests that breakage of any frangible elements through an inadvertent act is highly unlikely.

With this arrangement, an extremely simple and effective tamper evident cap is provided that is easy to install, provides a very secure grip on the vessel opening while in place, and is also very easy to remove without undue training of the operating staff. In addition, with the particular geometry of the cap of the present invention, the cap is very simple and inexpensive to manufacture and can be easily molded as a single piece.

Various modifications and changes may be made by those having ordinary skill in the art without departing from the spirit and scope of this invention. Therefore, it must be understood that the illustrated embodiments of the present invention have been set forth only for the purpose of example, and that they should not be taken as limiting the invention as defined in the following claims.

The words used in this specification to describe the present invention are to be understood not only in the sense of their commonly defined meanings, but to include by special definition, structure, material, or acts beyond the scope of the commonly defined meanings. The definitions of the words or elements of the following claims are, therefore, defined in this specification to include not only the combination of elements which are literally set forth, but all equivalent structure, material, or acts for performing substantially the same function in substantially the same way to obtain substantially the same result.

In addition to the equivalents of the claimed elements, obvious substitutions now or later known to one of ordinary skill in the art are defined to be within the scope of the defined elements.

It is claimed:

1. A cap comprising:

a disc-shaped top;

a depending cylindrical wall extending at a substantially right angle from a circumference of the top and terminating at a lower edge in an inward facing annular lip;

a planar section extending radially outward from the lower edge of the wall and terminating in a downwardly- and outwardly-sloping outer edge;

at least two spaced perforations each extending radially outward across the planar section;

a pair of frangible lines separate from the perforation lines and defining a frangible strip extending from the outer edge, across the planar section, up the wall and across at least a portion of the disc-shaped top; and a pull tab attached to the frangible strip adapted for destructive removal of the cap by pulling the pull tab to cause the frangible lines to tear and release the frangible strip from the outer edge, the planar section and at least part of the disc-shaped top.

2. The cap according to claim 1, further including a bump on the pull-tab for raising the pull tab enabling a person to more easily grasp the pull tab.

3. The cap according to claim 1, wherein the cap is formed of a single piece of molded plastic.

4. The cap according to claim 1, wherein the cap thickness is between 0.010 to 0.020 of an inch.

5. The cap according to claim 1, wherein the cap is made of a plastic material selected from the group consisting of a high density polyethylene (HDPE), polopopylene (PP), low density polyethylene (LDPE), polybutylene (PB), a blend of ethylene vinyl acetate (EVA) with PB, COPP, ultralow density ethylene copolymers, polyolefin plastomers, and/or polyethylene.

6. The cap according to claim 1 wherein the annular lip is adapted to engage a drum cap affixed to the surface of a drum.

7. A cap comprising:

a disc-shaped top;

a depending cylindrical wall extending at a substantially right angle from a circumference of the top and terminating at a lower edge in an inward facing annular lip;

a planar section extending horizontally outward from the lower edge of the wall;

a ring at the lower edge of the planar section including perforations;

a pair of frangible lines, distinct from the perforations and defining a frangible strip extending from the lower edge of the wall, across the planar section, up the wall and across at least a portion of the disc-shaped top; and a pull tab attached to the frangible strip adapted for destructive removal of the cap by pulling the pull tab to thereby tear and release the frangible strip from the lower edge of the wall and at least a part of the disc-shaped top.

8. The cap according to claim 7, further including a bump on the pull-tab for raising the pull tab enabling a person to more easily grasp the pull tab.

9. The cap according to claim 7, wherein the cap is formed of a single piece of molded plastic.

10. The cap according to claim 7, wherein the cap thickness is between 0.010 to 0.020 of an inch.

11. The cap according to claim 7, wherein the cap is made of a plastic material selected from the group consisting of a high density polyethylene (HDPE), polopopylene (PP), low density polyethylene (LDPE), polybutylene (PB), a blend of ethylene vinyl acetate (EVA) with PB, COPP, ultralow density ethylene copolymers, polyolefin plastomers, and/or polyethylene.

12. The cap according to claim 7 wherein the annular lip is adapted to engage a drum cap affixed to the surface of a drum.

13. A cap comprising:

a substantially planar top;

a substantially cylindrical wall depending from the base of the top terminating in an internal annular lip;

a circular planar section depending from the exterior of the cylindrical wall;

a perforation defining a tamper evident means making up at least a portion of the planar section; and a pair of frangible lines extending from the planar section, up the cylindrical wall and across a portion of the top, the frangible lines defining a frangible strip suitable for tearing to release the frangible strip from the planar section, the cylindrical wall and a portion of the top.

14. The cap according to claim 13, further including a bump on the pull-tab for raising the pull tab enabling a person to more easily grasp the pull tab.

15. The cap according to claim 13, wherein the cap is formed of a single piece of molded plastic.

16. The cap according to claim 13, wherein the cap thickness is between 0.010 to 0.020 of an inch.

17. The cap according to claim 13, wherein the cap is made of a plastic material selected from the group consisting of a high density polyethylene (HDPE), polopopylene (PP), low density polyethylene (LDPE), polybutylene (PB), a blend of ethylene vinyl acetate (EVA) with PB, COPP, ultralow density ethylene copolymers, polyolefin plastomers, and/or polyethylene.

18. The cap according to claim 13 wherein the annular lip is adapted to engage a drum cap affixed to the surface of a drum.

* * * * *